US011827395B2

(12) United States Patent
Långvik et al.

(10) Patent No.: US 11,827,395 B2
(45) Date of Patent: Nov. 28, 2023

(54) AUTOMATIC-STRAP-FEEDING SYSTEM FOR FEEDING STRAP INTO A STRAPPING MACHINE

(71) Applicant: Signode Finland Oy, Masku (FI)

(72) Inventors: Mikko Långvik, Porvoo (FI); Jani Petteri Kyyhkynen, Askola (FI)

(73) Assignee: Signode Finland Oy, Masku (FI)

( * ) Notice: Subject to any disclaimer, the term of this patent is extended or adjusted under 35 U.S.C. 154(b) by 0 days.

(21) Appl. No.: 17/404,601

(22) Filed: Aug. 17, 2021

(65) Prior Publication Data

US 2022/0063851 A1 Mar. 3, 2022

(30) Foreign Application Priority Data

Aug. 28, 2020 (EP) ..... 20193441

(51) Int. Cl.
*B65B 13/06* (2006.01)

(52) U.S. Cl.
CPC ..... *B65B 13/06* (2013.01)

(58) Field of Classification Search
CPC ..... B65B 13/06; B65B 13/18; B65H 16/021
See application file for complete search history.

(56) References Cited

U.S. PATENT DOCUMENTS 3,263,883 A * 8/1966 Waltz ..... B65H 35/0026 225/36
5,299,407 A 4/1994 Schuttler et al.
5,333,438 A * 8/1994 Gurak ..... B65B 13/20 53/399
6,038,967 A * 3/2000 Chak ..... B65B 13/22 53/64
6,086,011 A 7/2000 Shibazaki et al.
6,105,344 A * 8/2000 Maeda ..... B65B 13/18 53/589
7,770,356 B2 * 8/2010 Frazier ..... B65B 51/08 53/64
2004/0200191 A1 * 10/2004 Armstrong ..... B65B 13/06 53/399

(Continued)

FOREIGN PATENT DOCUMENTS

WO WO-9601186 A1 * 1/1996 ..... B29C 65/222

OTHER PUBLICATIONS

"Extended European Search Report, Corrected Version", from corresponding European Patent Application No. 20193441.1, dated Feb. 5, 2021.

(Continued)

*Primary Examiner* — Anna K Kinsaul
*Assistant Examiner* — Luis G Del Valle
(74) *Attorney, Agent, or Firm* — Neal, Gerber & Eisenberg LLP

(57) ABSTRACT

Various embodiments of the present disclosure provide an automatic-strap-feeding system for feeding strap to a strapping machine. The automatic-strap-feeding system is configured to feed strap from either one of two separate strap coils to the strapping machine; to determine when that strap coil is running low on strap; and, in response, automatically switch to the other (full) strap coil. This quick and automated switchover process minimizes strapping machine downtime and reduces stress on operators to quickly swap the depleted strap coil with a full one.

9 Claims, 10 Drawing Sheets

(56) References Cited

U.S. PATENT DOCUMENTS

| | | | | |
|---|---|---|---|---|
| 2005/0241270 | A1* | 11/2005 | Katsumata | B65B 13/22 53/64 |
| 2009/0223388 | A1* | 9/2009 | Doyle | B65B 13/06 100/1 |
| 2013/0068117 | A1* | 3/2013 | Haberstroh | B65B 13/18 100/25 |
| 2017/0015451 | A1* | 1/2017 | Huber | B65B 13/22 |
| 2022/0024622 | A1* | 1/2022 | Mårstedt | B65B 13/32 |

OTHER PUBLICATIONS

"Office Action and Examination Search Report", corresponding Canadian Patent Application No. 3,128,990, dated Jan. 20, 2023.

* cited by examiner

AUTOMATIC-STRAP-FEEDING SYSTEM FOR FEEDING STRAP INTO A STRAPPING MACHINE

PRIORITY

This application claims priority to and the benefit of European Patent Application No. 20193441.1, filed Aug. 28, 2020, the entire contents of which are incorporated herein by reference.

FIELD

The present disclosure relates to automatic-strap-feeding systems for feeding strap to strapping machines.

BACKGROUND

A strapping machine forms a tensioned loop of plastic strap (such as polyester or polypropylene strap) or metal strap (such as steel strap) around a load. A typical strapping machine includes a support surface that supports the load, a strap chute that defines a strap path and circumscribes the support surface, a strapping head that forms the strap loop and is positioned in the strap path, a controller that controls the strapping head to strap the load, and a frame that supports these components.

To strap the load, the strapping head draws strap from a strap supply and feeds the strap (leading strap end first) into and through the strap chute (along the strap path) until the leading strap end returns to the strapping head. While holding the leading strap end, the strapping head retracts the strap to pull the strap out of the strap chute and onto the load and tensions the strap to a designated strap tension. The strapping head cuts the strap from the strap supply to form a trailing strap end and attaches the leading and trailing strap ends to one another (such as via friction welding, hot-knife welding, ultrasonic welding, or any other suitable method), thereby forming a tensioned strap loop around the load.

A typical strap supply includes a strap dispenser on which a strap coil is rotatably mounted. When the strap coil is depleted (or runs low), an operator must shut down the strapping machine—thereby shutting down the production line that the strapping machine is a part of—and replace the strap coil. Specifically, the operator must remove the depleted strap coil, obtain a new (full) strap coil, install the new strap coil on the strap dispenser, and introduce strap from the new strap coil into the strapping machine. Only then can the operator re-start the strapping machine so production can resume.

SUMMARY

Various embodiments of the present disclosure provide an automatic-strap-feeding system for feeding strap to a strapping machine. The automatic-strap-feeding system is configured to feed strap from either one of two separate strap coils to the strapping machine; to determine when that strap coil is running low on strap; and, in response, automatically switch to the other (full) strap coil. This quick and automated switchover process minimizes strapping machine downtime and reduces stress on operators to quickly swap the depleted strap coil with a full one.

One embodiment of the automatic strap feeding system of the present disclosure for selectively feeding strap from a first strap coil and strap from a second strap coil into a strapping machine comprises: (1) a strap-driving assembly comprising: a first strap guide defining a first strap channel; a second strap guide spaced-apart from the first strap guide and defining a second strap channel; and (2) a third strap guide defining a third strap channel, wherein the third strap guide is movable relative to the first and second strap guides from a first position in which the third strap channel is aligned with the first strap channel and a second position in which the third strap channel is aligned with the first strap channel.

Another embodiment of the automatic strap feeding system of the present disclosure for selectively feeding strap from a first strap coil and strap from a second strap coil into a strapping machine comprises: (1) a housing; (2) a strap-driving assembly supported by the housing and comprising: a first strap guide defining a first strap channel having a first-strap-channel inlet and a first-strap-channel outlet; a first drive roller adjacent the first strap channel; a second strap guide spaced-apart from the first strap guide and defining a second strap channel having a second-strap-channel inlet and a second-strap-channel outlet; and (3) a second drive roller adjacent the second strap channel; and a third strap guide defining a third strap channel having a third-strap-channel inlet and a third-strap-channel outlet, wherein the third strap guide is movable relative to the first and second strap guides from a first position in which the third strap channel is aligned with the first strap channel and a second position in which the third strap channel is aligned with the first strap channel.

One embodiment of a method for operating an automatic-strap-feeding system of the present disclosure comprises: after strap remaining in a first strap coil has fallen below a designated amount of strap, retracting the strap of the first strap coil from a strapping machine and through third and first strap guides; ejecting the retracted strap of the first strap coil from the third strap guide; aligning the third strap guide with a second strap guide; and feeding strap of a second strap coil from the second strap guide, through the third strap guide, and into the strapping machine.

DETAILED DESCRIPTION

Figure 1:
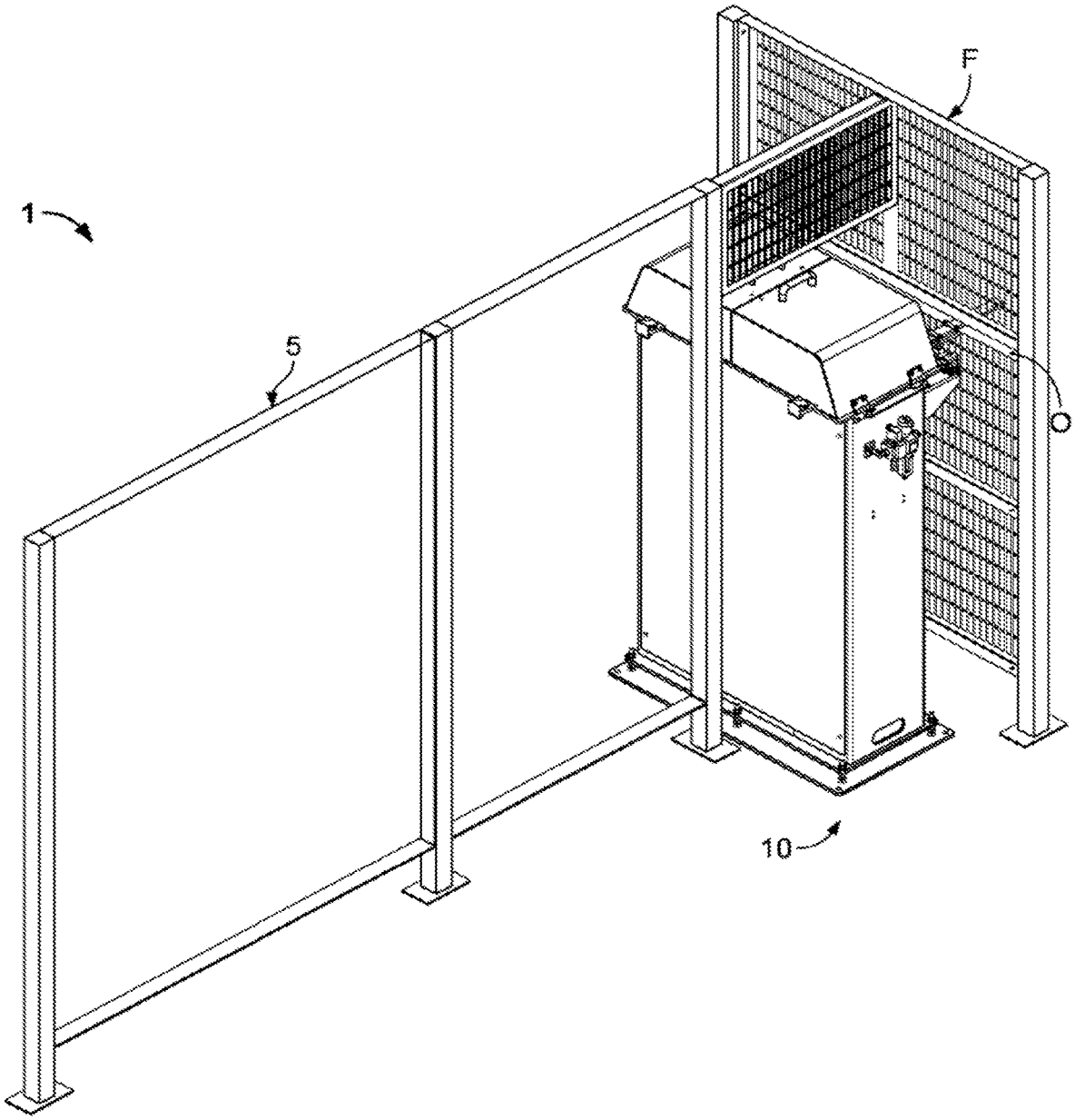
FIG. 1 is a perspective view of one example embodiment of an automatic-strap-feeding system of the present disclosure.

While the systems, devices, and processes described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connection of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting methods, such as coupled, mounted, connected, etc., are not intended to be limited to direct mounting methods, but should be interpreted broadly to include indirect and operably coupled, mounted, connected, and like mounting methods. This specification is intended to be taken as a whole and interpreted in accordance with the principles of the present disclosure and as understood by one of ordinary skill in the art.

Various embodiments of the present disclosure provide an automatic-strap-feeding system for feeding strap to a strapping machine. The automatic-strap-feeding system is configured to feed strap from either one of two separate strap coils to the strapping machine; to determine when that strap coil is running low on strap; and, in response, automatically switch to the other (full) strap coil. This quick and automated switchover process minimizes strapping machine downtime and reduces stress on operators to quickly swap the depleted strap coil with a full one.

Figure 2:
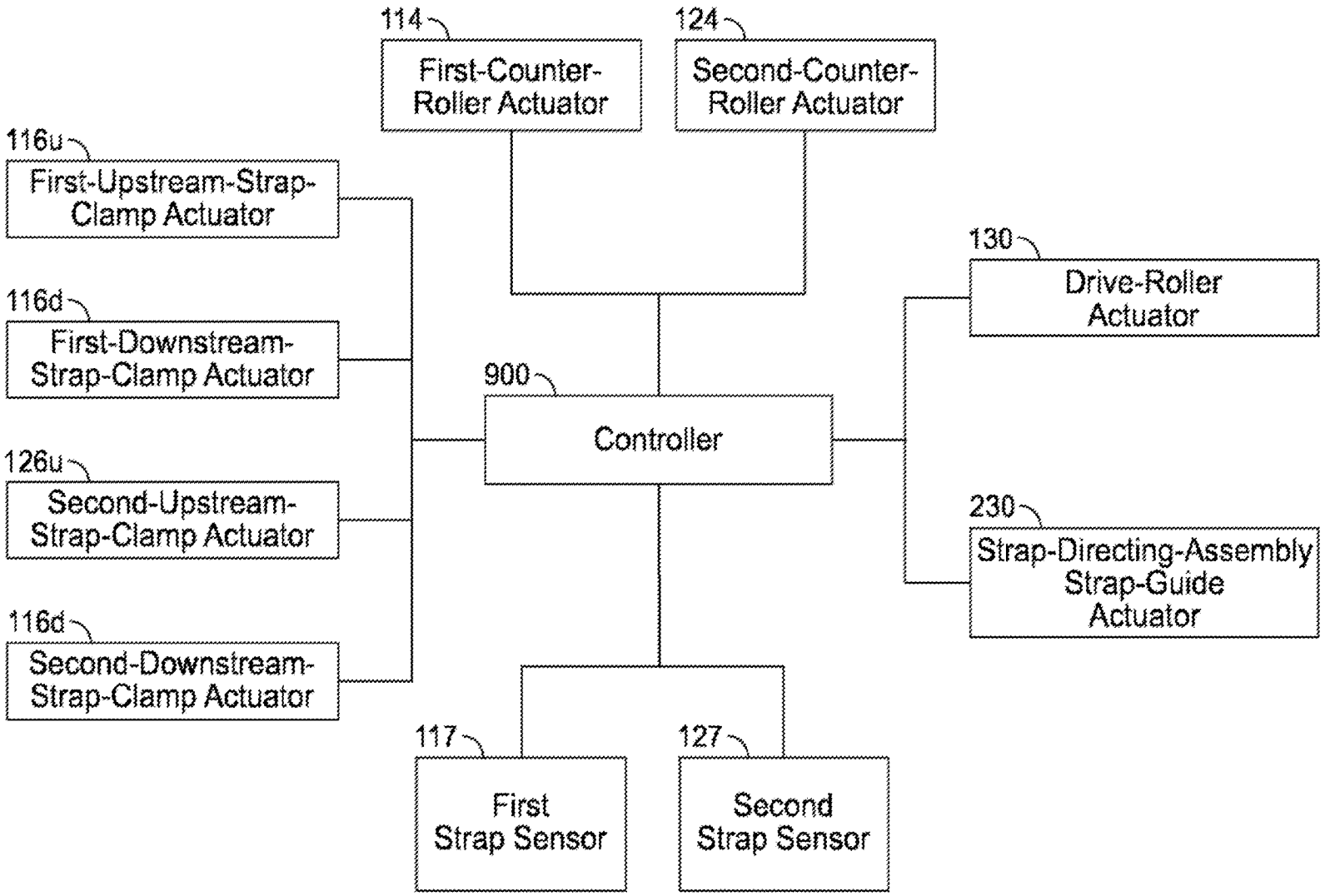
FIG. 2 is a block diagram showing certain components of the automatic-strap-feeding system of FIG. 1.
Figure 3:
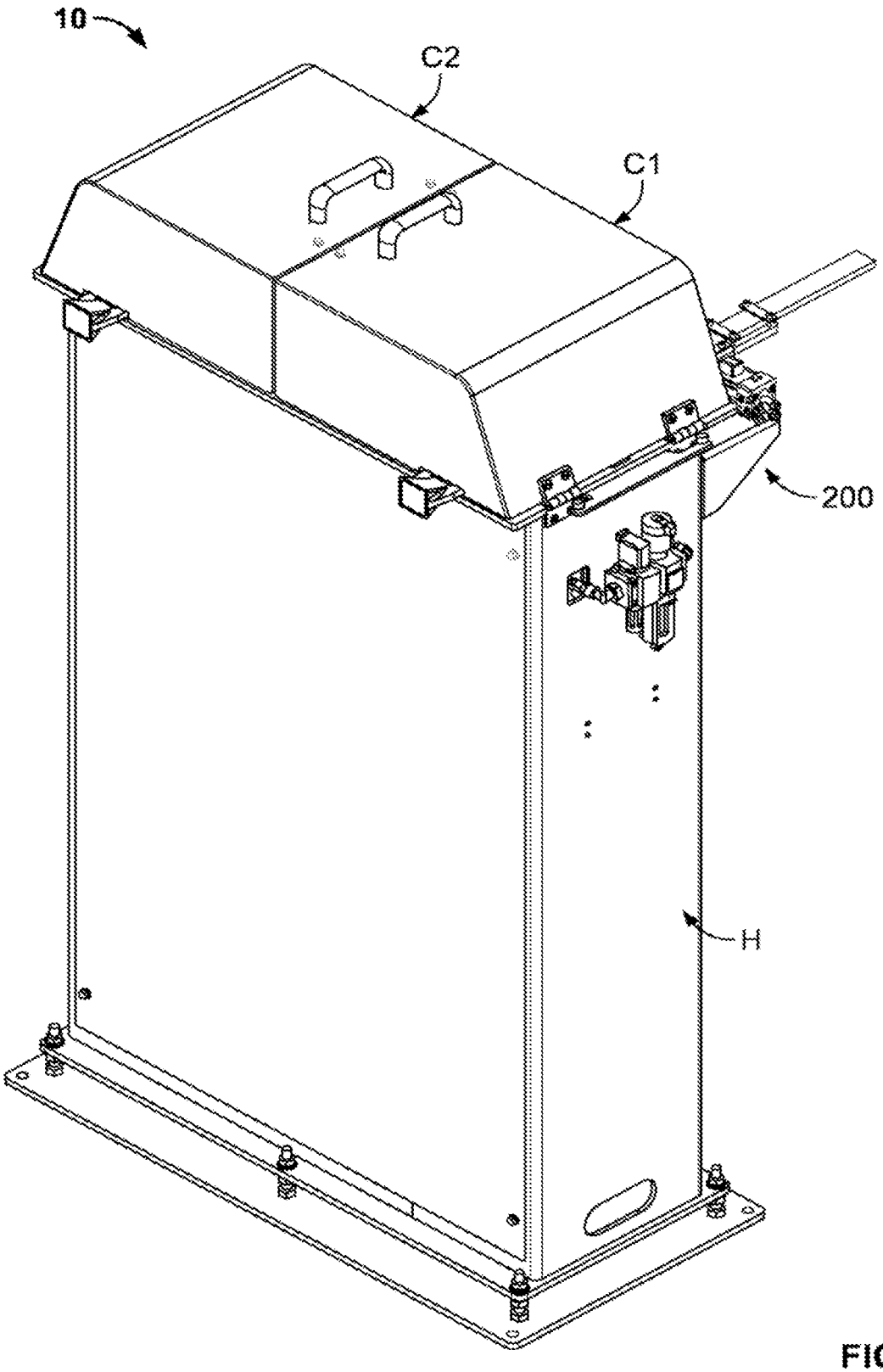
FIGS. 3 and 4 are perspective views of the automatic strap feeder of the automatic-strap-feeding system of FIG. 1.
Figure 4:
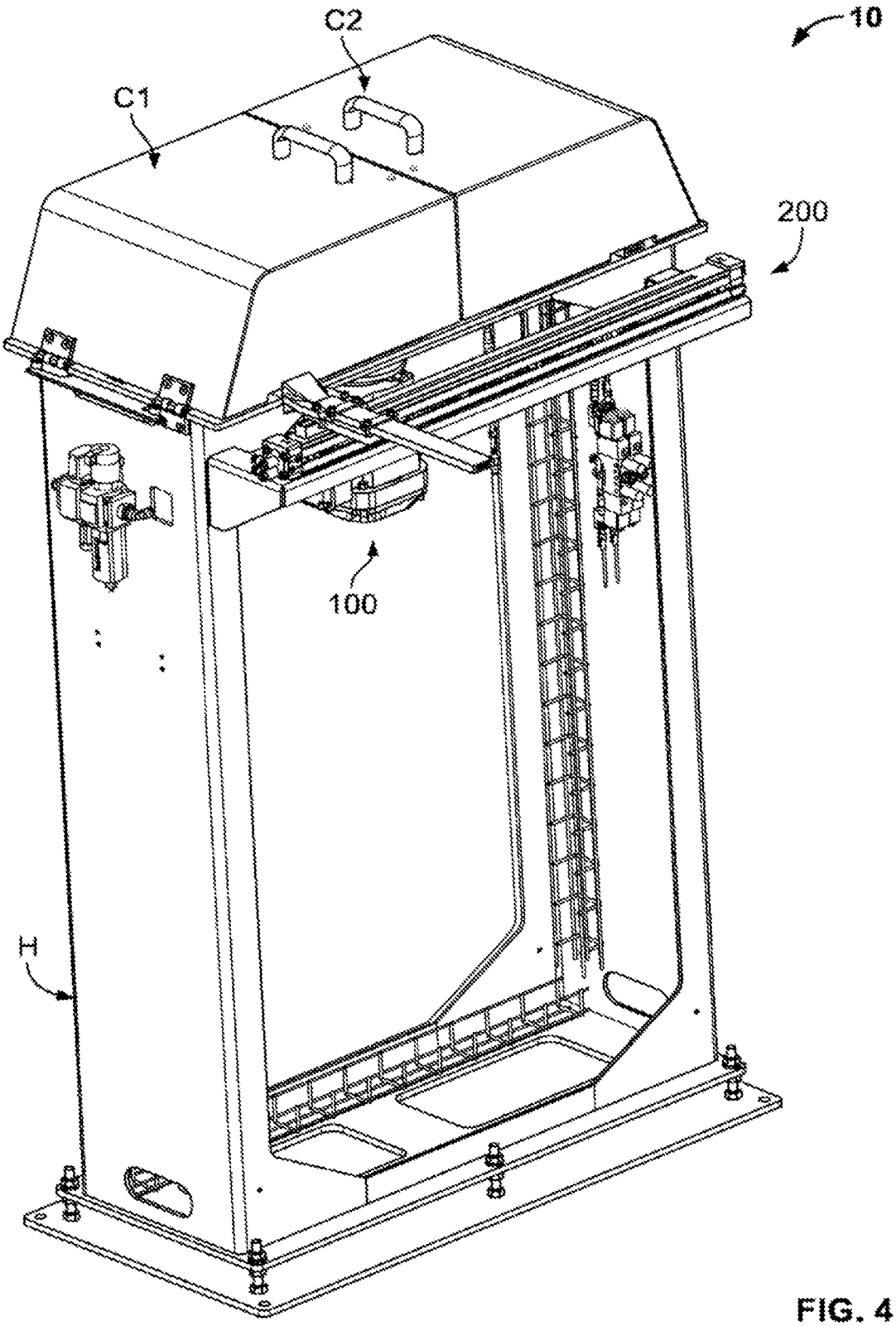
Figure 5:
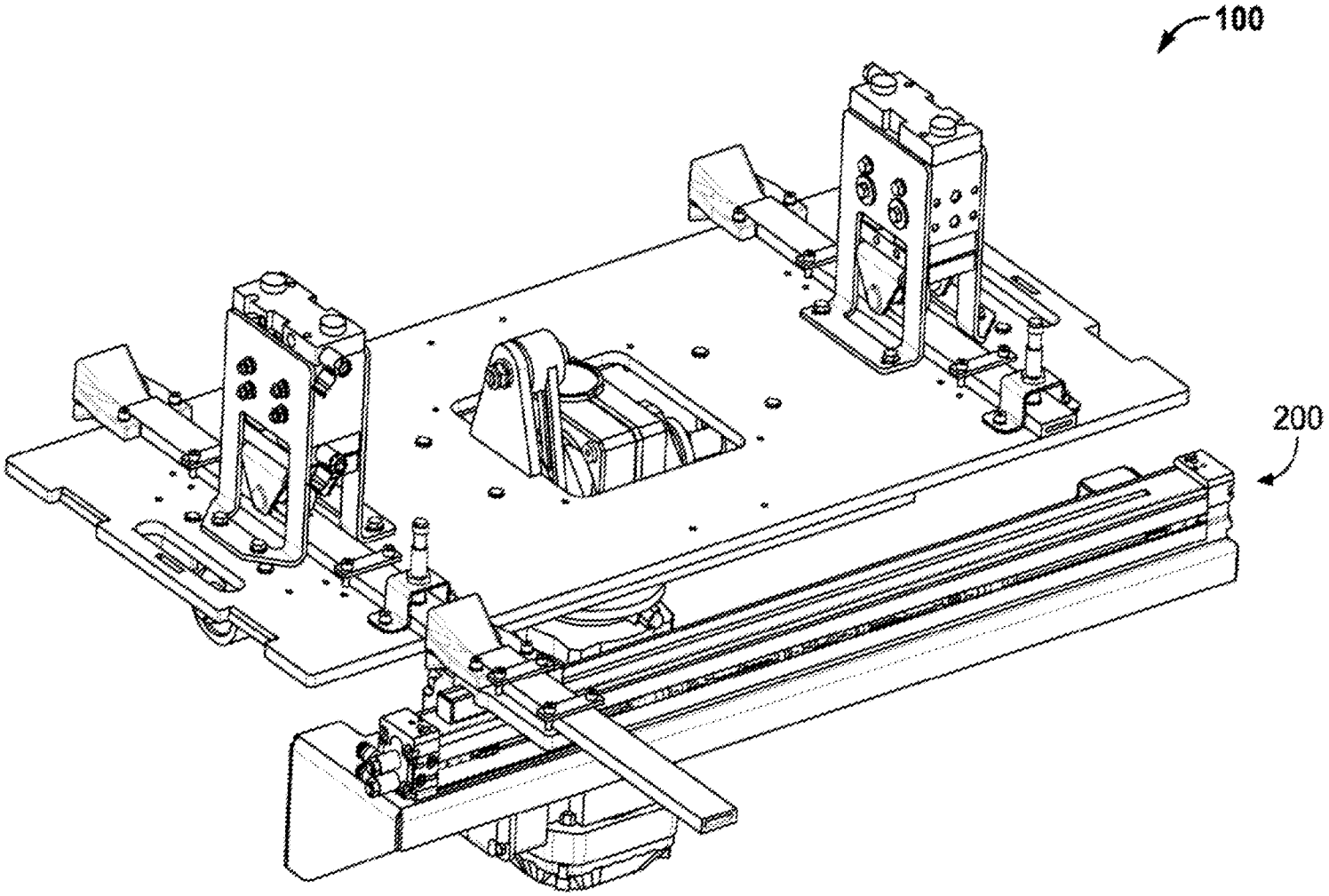
FIG. 5 is a perspective view of the strap-driving assembly and the strap-directing assembly of the automatic strap feeder of FIG. 2.

FIGS. 1 and 2 show one example embodiment of an automatic-strap-feeding system 1 of the present disclosure and components thereof. The automatic-strap-feeding system 1 includes an automatic strap feeder 10, a controller 900, a strap-supply separator S, and fencing F defining an opening O. Although not shown, the automatic-strap-feeding system 1 is (in this example embodiment) described as being used with first and separate strap supplies including first and second strap coils, respectively, and a strapping machine (also not shown) configured to form a tensioned loop of strap around a load.

The automatic strap feeder 10 controls which strap coil the strapping machine draws strap from. As shown in FIGS. 3-9, the automatic strap feeder 10 may include a housing H, a strap-driving assembly 100, a strap-directing assembly 200, and first and second covers C1 and C2.

The housing H may be sized, shaped, and otherwise configured to support the strap-driving assembly 100, the strap-directing assembly 200, and the first and second covers C1 and C2 and to at least partially enclose portions of the strap-driving assembly 100. The housing H is formed from any suitable combination of solid members, tubular members, plates, and/or any other suitable components fastened together. The first and second covers C1 and C2 may be pivotably connected to the housing H via hinges (not labeled). When in their closed positions (shown in the Figures), the first and second covers C1 and C2 enclose certain components of the strap-driving assembly 100. The first and second covers C1 and C2 may be pivotable to open positions (not shown) to permit access to those components of the strap-driving assembly 100.

Figure 6:
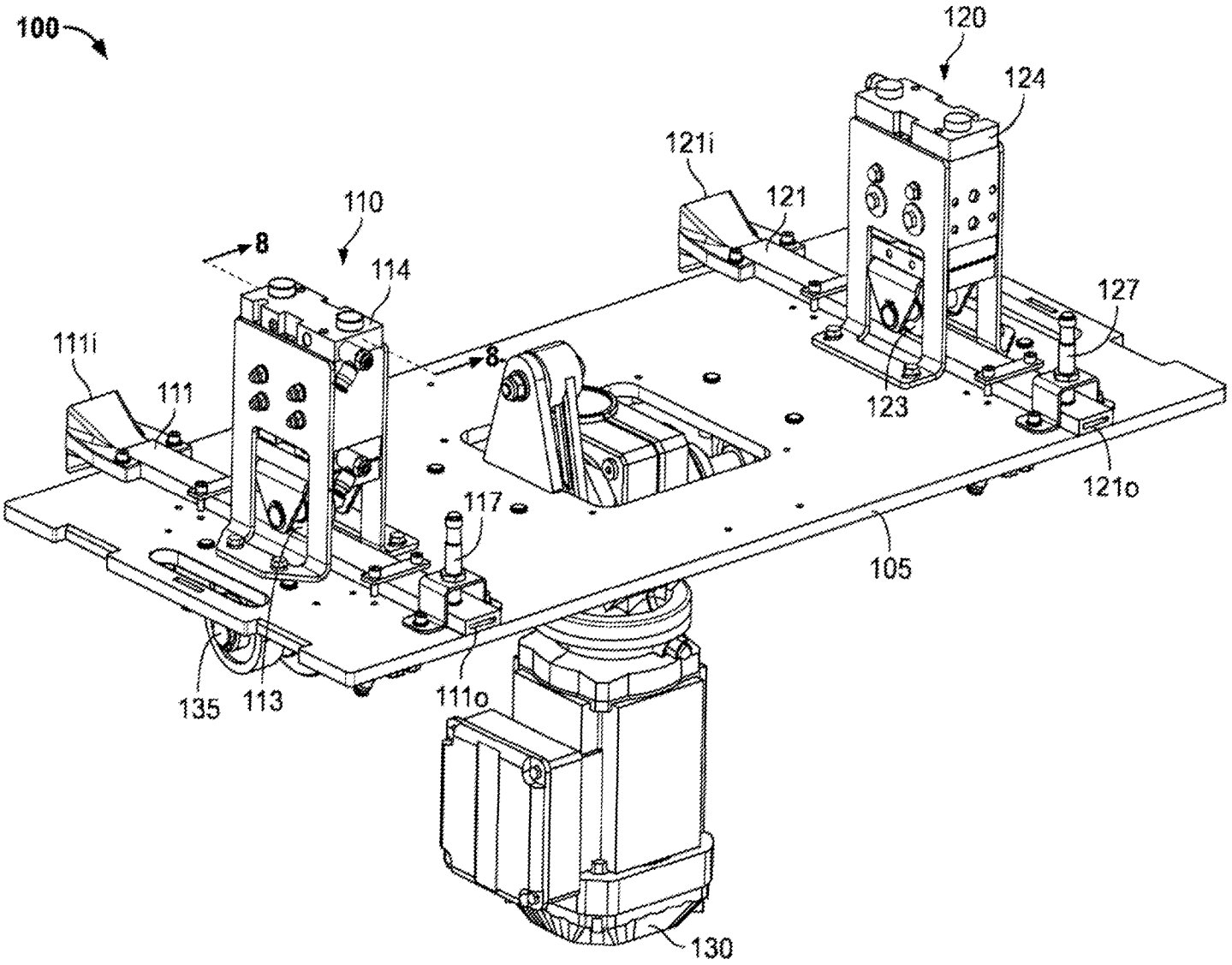
FIGS. 6 and 7 are perspective views of the strap-driving assembly of FIG. 5.
Figure 7:
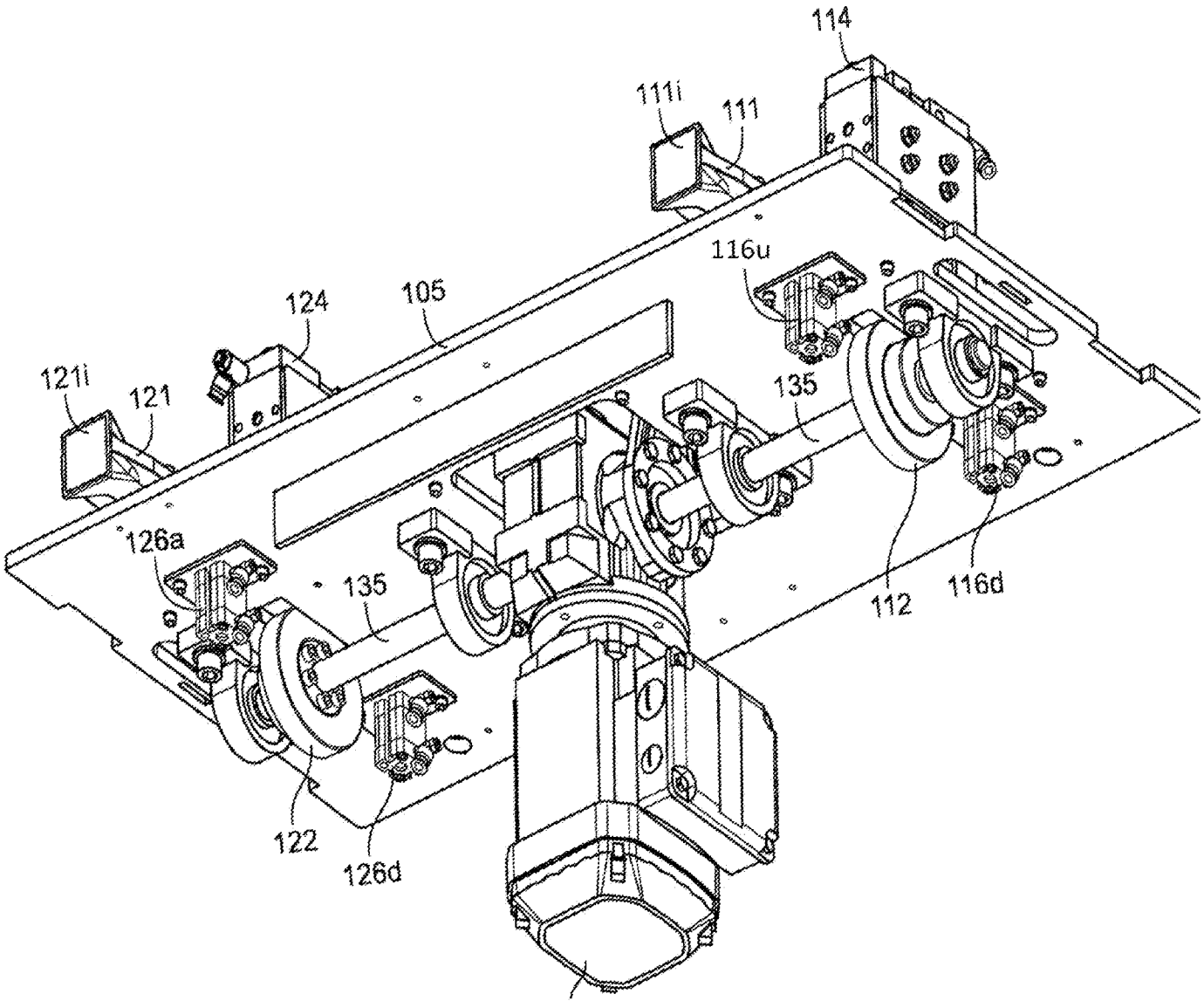
Figure 8:
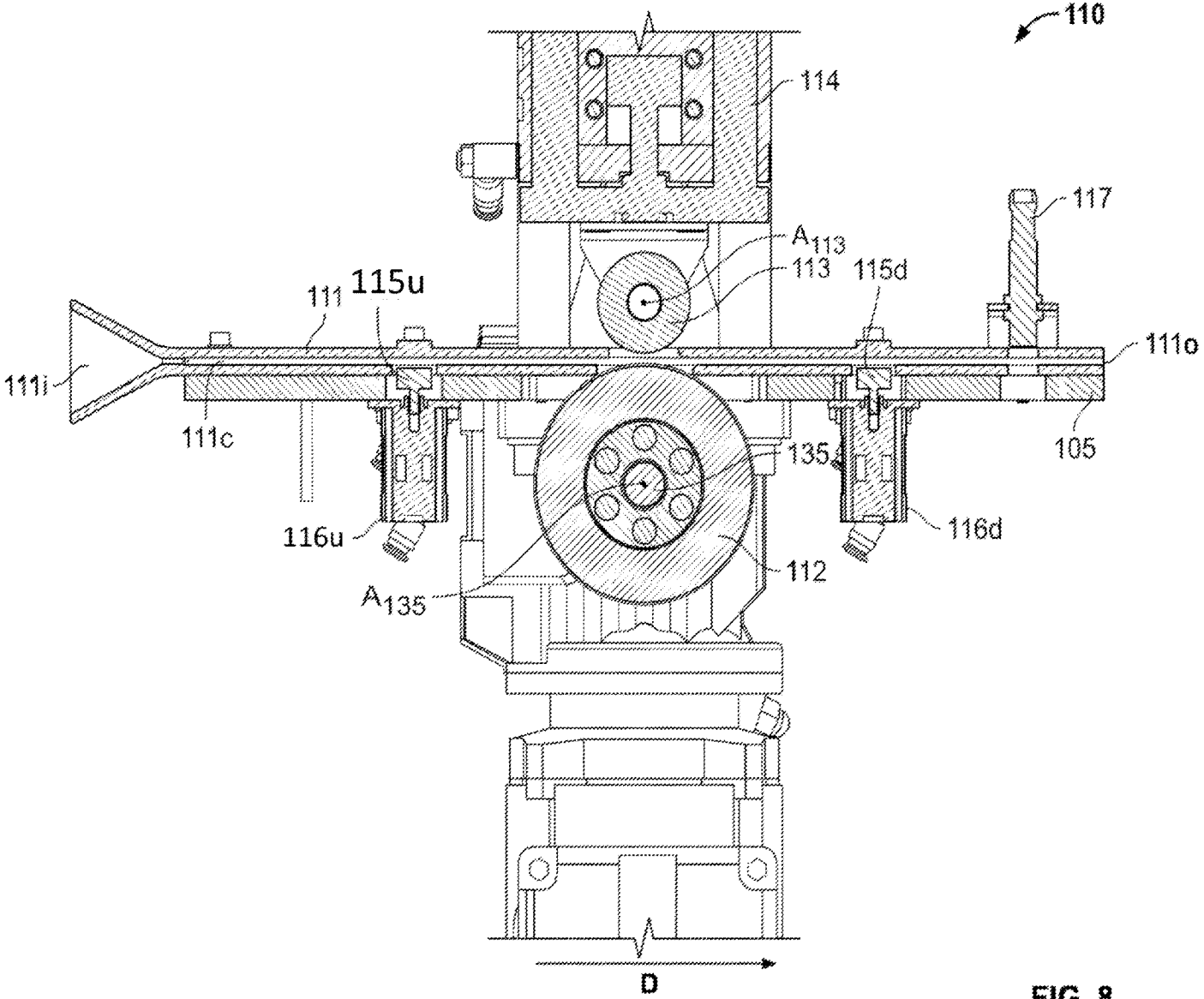
FIG. 8 is a cross-sectional elevational view of the strap-driving assembly of FIG. 6 taken substantially along line 8-8 of FIG. 6.

The strap-driving assembly 100 selectively interacts with the strap of the first and second strap coils to move the strap: (1) in a downstream direction D (FIG. 8) to feed the strap to the strapping machine; and (2) in an upstream direction (not shown) opposite the direction D to retract the strap from the strapping machine and eject the strap from the strap-driving assembly 100. The strap-driving assembly 100 may also selectively interact with strap from the first and second strap coils to clamp the strap in place in preparation for later feeding into the strapping machine. As best shown in FIGS. 6-8, the strap-driving assembly 100 may include a strap-driving-assembly support 105, a first strap-driving subassembly 110, a second strap-driving subassembly 120, a drive-roller actuator 130, and an output shaft 135.

The strap-driving-assembly support 105 supports and/or serves as a mount for the first strap-driving subassembly 110, the second strap-driving subassembly 120, the drive-roller actuator 130, and the output shaft 135. In this example embodiment, the strap-driving-assembly support 105 includes a plate (though it may be any other suitable component) mounted to the housing H such that it separates certain components of the first strap-driving subassembly 110 and separates certain components of the second strap-driving subassembly 120. Cutouts (not labeled) formed in the strap-driving-assembly support 105 may enable these components to engage or otherwise interact with the strap as described in detail below.

The first strap-driving subassembly 110 interacts with the strap of the first strap coil to move the strap: (1) in the downstream direction D to feed the strap to the strapping machine; and (2) in the upstream direction to retract the strap from the strapping machine and eject the strap from the first strap-driving subassembly 110. The first strap-driving subassembly 110 also selectively interacts with the strap from the first strap coil to clamp the strap in place in preparation for later feeding into the strapping machine. As best shown in FIG. 8, the first strap-driving subassembly 110 may include a first strap-driving-subassembly strap guide 111, a first drive roller 112, a first counter roller 113, a first-counter-roller actuator 114, a first upstream strap clamp 115*u*, a first downstream strap clamp 115d, a first-upstream-strap-clamp actuator 116*u*, a first-downstream-strap-clamp actuator 116d, and/or a first strap sensor 117.

The first strap-driving-subassembly strap guide 111 (which may be referred to herein as the "first strap guide" for clarity) directs strap from the first strap coil to the strap-directing assembly 200. The first strap guide 111 includes a generally tubular member that is fixedly connected to the strap-driving-assembly support 105 (via welding, fasteners, or any other suitable manner) and that defines a first strap channel 111*c* having a tapered first-strap-channel inlet 111*i* and a first strap-channel outlet 111*o*. The first strap channel 111*c* is sized, shaped, and otherwise configured so strap can be fed from the first strap coil into the first-strap-channel inlet 111*i*, move through the first strap channel 111*c*, and exit at the first-strap-channel outlet 111*o*. Cutouts (not labeled) formed in the first strap guide 111 enable some of these components to engage or otherwise interact with the strap, as described in detail below.

The first drive roller 112 cooperates with the first counter roller 113 (described below) to move the strap in the downstream and upstream directions. The first drive roller 112 may be fixedly mounted to the output shaft 135 and configured to rotate with the output shaft 135 about a rotational axis $A_{135}$ under control of the drive-roller actuator 130 (as described below). The first drive roller 112 may be sized, shaped, positioned, and/or otherwise configured so its rotational axis $A_{135}$ is below the first strap guide 111 and so its perimeter extends through a cutout formed in the strap-driving-assembly support 105 and into a cutout formed in the first strap guide 111. This enables the first drive roller 112 to engage or otherwise interact with the strap, as described in detail below. In certain embodiments, the perimeter of the first drive roller is textured (for instance, knurled or toothed) and/or is formed from a high-friction material to improve its ability to engage or otherwise interact with the strap. In other embodiments, the rotational axis of the first drive roller is positioned above the first strap guide.

The first counter roller 113 selectively engages the first drive roller 112 to enable the first drive roller 112 to move the strap. The first counter roller 113 is freely rotatable about a rotational axis $A_{113}$ and may be movable in the vertical direction between an engaged position adjacent the first drive roller 112 and a retracted position further from the first drive roller 112. The first counter roller 113 may be sized, shaped, positioned, and/or otherwise configured so its rotational axis $A_{113}$ is above the first strap guide 111 and so its perimeter extends through a cutout formed in the first strap guide 111 and into the first strap channel 111*c* when in its engaged position. This enables the first counter roller 113 to—when in its engaged position—engage or otherwise interact with the strap, as described in detail below. Conversely, the first counter roller 113 may be sized, shaped, positioned, and/or otherwise configured so its perimeter is removed from the first strap channel 111*c* when in its retracted position so as not to interfere with the strap, as described in detail below. In certain embodiments, the perimeter of the first counter roller is textured (for instance, knurled or toothed) and/or is formed from a high-friction material to improve its ability to engage or otherwise interact with the strap. In other embodiments, the rotational axis of the first counter roller is positioned below the first strap guide.

The first-counter-roller actuator 114 is operably connected to the first counter roller 113 and configured to move the first counter roller 113 between its engaged and retracted positions. In this example embodiment, the first-counter-roller actuator includes a double-acting pneumatic cylinder, though the first-counter-roller actuator may be any other suitable actuator (such as an electric motor or a hydraulic actuator) in other embodiments. In other embodiments, a biasing element (such as a spring) biases the first counter roller to its retracted position or its engaged position. In these embodiments, the first-counter-roller actuator is operably connected to the first counter roller and configured to move the first counter roller against the biasing force of the biasing element to its engaged or retracted position (as applicable), and when necessary to allow the biasing element to move the first counter roller to its other position.

The first upstream strap clamp 115*u* clamps the strap in place relative to the first strap guide 111. The first upstream strap clamp 115*u* may include a body and a head (neither of which is labeled) connected to the body. The first upstream strap clamp 115*u* is positioned upstream of the first drive roller 112 and is movable relative to the first strap guide 111 between a clamping position (not shown) and a retracted position (FIG. 8). When in its clamping position, the head of the first upstream strap clamp 115*u* is positioned in the first strap channel 111*c* and, when strap is present in the first strap channel 111*c*, clamps the strap against the upper wall of the first strap guide 111. When in its retracted position, the first upstream strap clamp 115*u* is removed from the first strap channel 111*c* so as not to interfere with the strap.

The first-upstream-strap-clamp actuator 116*u* is operably connected to the first upstream strap clamp 115*u* and configured to move the first upstream strap clamp 115*u* between its clamping and retracted positions. In this example embodiment, the first-upstream-strap-clamp actuator includes a double-acting pneumatic cylinder, though the first-upstream-strap-clamp actuator may be any other suitable actuator (such as an electric motor or a hydraulic actuator) in other embodiments. In other embodiments, a biasing element (such as a spring) biases the first upstream strap clamp to its retracted position or its clamping position. In these embodiments, the first-upstream-strap-clamp actuator is operably connected to the first upstream strap clamp and configured to move the first upstream strap clamp against the biasing force of the biasing element to its clamping or retracted position (as applicable), and when necessary to allow the biasing element to move the first upstream strap clamp to its other position.

The first downstream strap clamp 115*d* clamps the strap in place relative to the first strap guide 111. The first downstream strap clamp 115*d* may include a body and a head (neither of which is labeled) connected to the body. The first downstream strap clamp 115*d* is positioned downstream of the first drive roller 112 and is movable relative to the first strap guide 111 between a clamping position (not shown) and a retracted position (FIG. 8). When in its clamping position, the head of the first downstream strap clamp 115*d* is positioned in the first strap channel 111*c* and, when strap is present in the first strap channel 111*c*, clamps the strap against the upper wall of the first strap guide 111. When in its retracted position, the first downstream strap clamp 115*d* is removed from the first strap channel 111*c* so as not to interfere with the strap.

The first-downstream-strap-clamp actuator 116*d* is operably connected to the first downstream strap clamp 115*d* and configured to move the first downstream strap clamp 115*d* between its clamping and retracted positions. In this example embodiment, the first-downstream-strap-clamp actuator includes a double-acting pneumatic cylinder, though the first-downstream-strap-clamp actuator may be any other suitable actuator (such as an electric motor or a hydraulic actuator) in other embodiments. In other embodiments, a biasing element (such as a spring) biases the first downstream strap clamp to its retracted position or its clamping position. In these embodiments, the first-downstream-strap-clamp actuator is operably connected to the first downstream strap clamp and configured to move the first downstream strap clamp against the biasing force of the biasing element to its clamping or retracted position (as applicable), and when necessary to allow the biasing element to move the first downstream strap clamp to its other position.

In other embodiments, the first strap-driving subassembly includes only one of the first upstream and downstream strap clamps (and its corresponding strap-clamp actuator).

The first strap sensor 117 is positioned downstream of the first downstream strap clamp 115*d* and includes any suitable sensor, such as a photoelectric sensor, configured to detect the presence of the strap. As described in more detail below, the first strap sensor 117 is communicatively connected to the controller 900 and configured to generate and send signals to the controller 900 responsive to detecting the strap and, afterwards, no longer detecting the strap. In other embodiments the first strap sensor 117 may be positioned in any suitable location so long as the first strap sensor 117 can detect the strap.

The second strap-driving subassembly 120 interacts with the strap of the second strap coil to move the strap: (1) in the downstream direction D to feed the strap to the strapping machine; and (2) in the upstream direction to retract the strap from the strapping machine and eject the strap from the second strap-driving subassembly 120. The second strap-driving subassembly 120 also selectively interacts with the strap from the second strap coil to clamp the strap in place in preparation for later feeding into the strapping machine. The second strap-driving subassembly 120 may include the same components as the first strap-driving subassembly 110. While not all of those components are shown in the Figures, they are provided element numbers (that correlate to their counterparts of the first strap-driving subassembly 110) for clarity. The second strap-driving subassembly 120 may include a second strap-driving-subassembly strap guide 121, a second drive roller 122, a second counter roller 123, a second-counter-roller actuator 124, a second upstream strap clamp 125*u*, a second downstream strap clamp 125*d*, a second-upstream-strap-clamp actuator 126*u*, a second-downstream-strap-clamp actuator 126*d*, and/or a second strap sensor 127.

The second strap-driving-subassembly strap guide 121 (which may be referred to herein as the "second strap guide" for clarity) directs strap from the second strap coil to the strap-directing assembly 200. The second strap guide 121 includes a generally tubular member that may be fixedly connected to the strap-driving-assembly support 105 (via welding, fasteners, or any other suitable manner) and that defines a second strap channel 121*c* having a tapered second-strap-channel inlet 121*i* and a second strap-channel outlet 121*o*. The second strap channel 121*c* is sized, shaped, and/or otherwise configured so strap can be fed from the second strap coil into the second-strap-channel inlet 121*i*, extend through the second strap channel 121*c*, and exit at the second-strap-channel outlet 121*o*. Cutouts (not labeled) formed in the second strap guide 121 enable some of these components to engage or otherwise interact with the strap, as described in detail below. The second strap guide 121 is spaced-apart from and may be generally parallel to the first strap guide 111, which means that the second strap channel 121*c* is spaced-apart from and may be generally parallel to the first strap channel 111*c*.

The second drive roller 122 cooperates with the second counter roller 123 (described below) to move the strap in the downstream and upstream directions. The second drive roller 122 may be fixedly mounted to the output shaft 135 and configured to rotate with the output shaft 135 about a rotational axis $A_{135}$ under control of the drive-roller actuator 130 (as described below). The second drive roller 122 is sized, shaped, positioned, and/or otherwise configured so its rotational axis $A_{135}$ is below the second strap guide 121 and so its perimeter extends through a cutout formed in the strap-driving-assembly support 105 and into a cutout formed in the second strap guide 121. This enables the second drive roller 122 to engage or otherwise interact with the strap, as described in detail below. In certain embodiments, the perimeter of the second drive roller is textured (for instance, knurled or toothed) and/or is formed from a high-friction material to improve its ability to engage or otherwise interact with the strap. In other embodiments, the rotational axis of the second drive roller is positioned above the second strap guide.

The second counter roller 123 selectively engages the second drive roller 122 to enable the second drive roller 122 to move the strap. The second counter roller 123 is freely rotatable about a rotational axis $A_{123}$ and is movable in the vertical direction between an engaged position adjacent the second drive roller 122 and a retracted position further from the second drive roller 122. The second counter roller 123 may be sized, shaped, positioned, and/or otherwise configured so its rotational axis $A_{123}$ is above the second strap guide 121 and so its perimeter extends through a cutout formed in the second strap guide 121 and into the second strap channel 121*c* when in its engaged position. This enables the second counter roller 123 to—when in its engaged position—engage or otherwise interact with the strap, as described in detail below. Conversely, the second counter roller 123 is sized, shaped, positioned, and otherwise configured so its perimeter is removed from the second strap channel 121*c* when in its retracted position so as not to interfere with the strap, as described in detail below. In certain embodiments, the perimeter of the second counter roller is textured (for instance, knurled or toothed) and/or is formed from a high-friction material to improve its ability to engage or otherwise interact with the strap. In other embodiments, the rotational axis of the second counter roller is positioned below the second strap guide.

The second-counter-roller actuator 124 is operably connected to the second counter roller 123 and configured to move the second counter roller 123 between its engaged and retracted positions. In this example embodiment, the second-counter-roller actuator includes a double-acting pneumatic cylinder, though the second-counter-roller actuator may be any other suitable actuator (such as an electric motor or a hydraulic actuator) in other embodiments. In other embodiments, a biasing element (such as a spring) biases the second counter roller to its retracted position or its engaged position. In these embodiments, the second-counter-roller actuator is operably connected to the second counter roller and configured to move the second counter roller against the biasing force of the biasing element to its engaged or retracted position (as applicable), and when necessary to allow the biasing element to move the second counter roller to its other position.

The second upstream strap clamp 125*u* clamps the strap in place relative to the second strap guide 121. The second upstream strap clamp 125*u* may include a body and a head (neither of which is labeled) connected to the body. The second upstream strap clamp 125*u* is positioned upstream of the second drive roller 122 and is movable relative to the second strap guide 121 between a clamping position (not shown) and a retracted position (FIG. 8). When in its clamping position, the head of the second upstream strap clamp 125*u* is positioned in the second strap channel 121*c* and, when strap is present in the second strap channel 121*c*, clamps the strap against the upper wall of the second strap guide 121. When in its retracted position, the second upstream strap clamp 125*u* is removed from the second strap channel 121*c* so as not to interfere with the strap.

The second-upstream-strap-clamp actuator 126*u* is operably connected to the second upstream strap clamp 125*u* and configured to move the second upstream strap clamp 125*u* between its clamping and retracted positions. In this example embodiment, the second-upstream-strap-clamp actuator includes a double-acting pneumatic cylinder, though the second-upstream-strap-clamp actuator may be any other suitable actuator (such as an electric motor or a hydraulic actuator) in other embodiments. In other embodiments, a biasing element (such as a spring) biases the second upstream strap clamp to its retracted position or its clamping position. In these embodiments, the second-upstream-strap-clamp actuator is operably connected to the second upstream strap clamp and configured to move the second upstream strap clamp against the biasing force of the biasing element to its clamping or retracted position (as applicable), and when necessary to allow the biasing element to move the second upstream strap clamp to its other position.

The second downstream strap clamp 125*d* clamps the strap in place relative to the second strap guide 121. The second downstream strap clamp 125*d* may include a body and a head (neither of which is labeled) connected to the body. The second downstream strap clamp 125*d* is positioned downstream of the second drive roller 122 and is movable relative to the second strap guide 121 between a clamping position (not shown) and a retracted position (FIG. 8). When in its clamping position, the head of the second downstream strap clamp 125*d* is positioned in the second strap channel 121*c* and, when strap is present in the second strap channel 121*c*, clamps the strap against the upper wall of the second strap guide 121. When in its retracted position, the second downstream strap clamp 125*d* is removed from the second strap channel 121*c* so as not to interfere with the strap.

The second-downstream-strap-clamp actuator 126*d* is operably connected to the second downstream strap clamp 125*d* and configured to move the second downstream strap clamp 125*d* between its clamping and retracted positions. In this example embodiment, the second-downstream-strap-clamp actuator includes a double-acting pneumatic cylinder, though the second-downstream-strap-clamp actuator may be any other suitable actuator (such as an electric motor or a hydraulic actuator) in other embodiments. In other embodiments, a biasing element (such as a spring) biases the second downstream strap clamp to its retracted position or its clamping position. In these embodiments, the second-downstream-strap-clamp actuator is operably connected to the second downstream strap clamp and configured to move the second downstream strap clamp against the biasing force of the biasing element to its clamping or retracted position (as applicable), and when necessary to allow the biasing element to move the second downstream strap clamp to its other position.

In other embodiments, the second strap-driving subassembly includes only one of the second upstream and downstream strap clamps (and its corresponding strap-clamp actuator).

The second strap sensor 127 is positioned downstream of the second downstream strap clamp 125*d* and includes any suitable sensor, such as a photoelectric sensor, configured to detect the presence of the strap. As described in more detail below, the second strap sensor 127 is communicatively connected to the controller 900 and configured to generate and send signals to the controller 900 responsive to detecting the strap and, afterwards, no longer detecting the strap. In other embodiments the second strap sensor 127 may be positioned in any suitable location so long as the second strap sensor 127 can detect the strap.

The drive-roller actuator 130 drives the first and second drive rollers 112 and 122 of the respective first and second strap-drive subassemblies 110 and 120. The drive-roller actuator 130 is mounted to the strap-driving-assembly support 105 between the first and second strap-drive subassemblies 120 and 120 (though it may be located elsewhere in other embodiments). The drive-roller actuator 130 is operatively connected to and configured to drive the drive rollers 112 and 122 of the respective first and second strap-drive subassemblies 110 and 120 via the output shaft 135, which extends between the first and second drive rollers 112 and 122 in this example embodiment. In this example embodiment, the drive-roller actuator includes an electric motor, though the drive-roller actuator may be any other suitable actuator (such as a hydraulic or pneumatic actuator) in other embodiments. In other embodiments, the strap-driving assembly includes two independently controlled drive-roller actuators, the first of which is operatively connected to the first drive roller of the first strap-driving subassembly and the second of which is operatively connected to the second drive roller of the second strap-driving subassembly.

Figure 9:
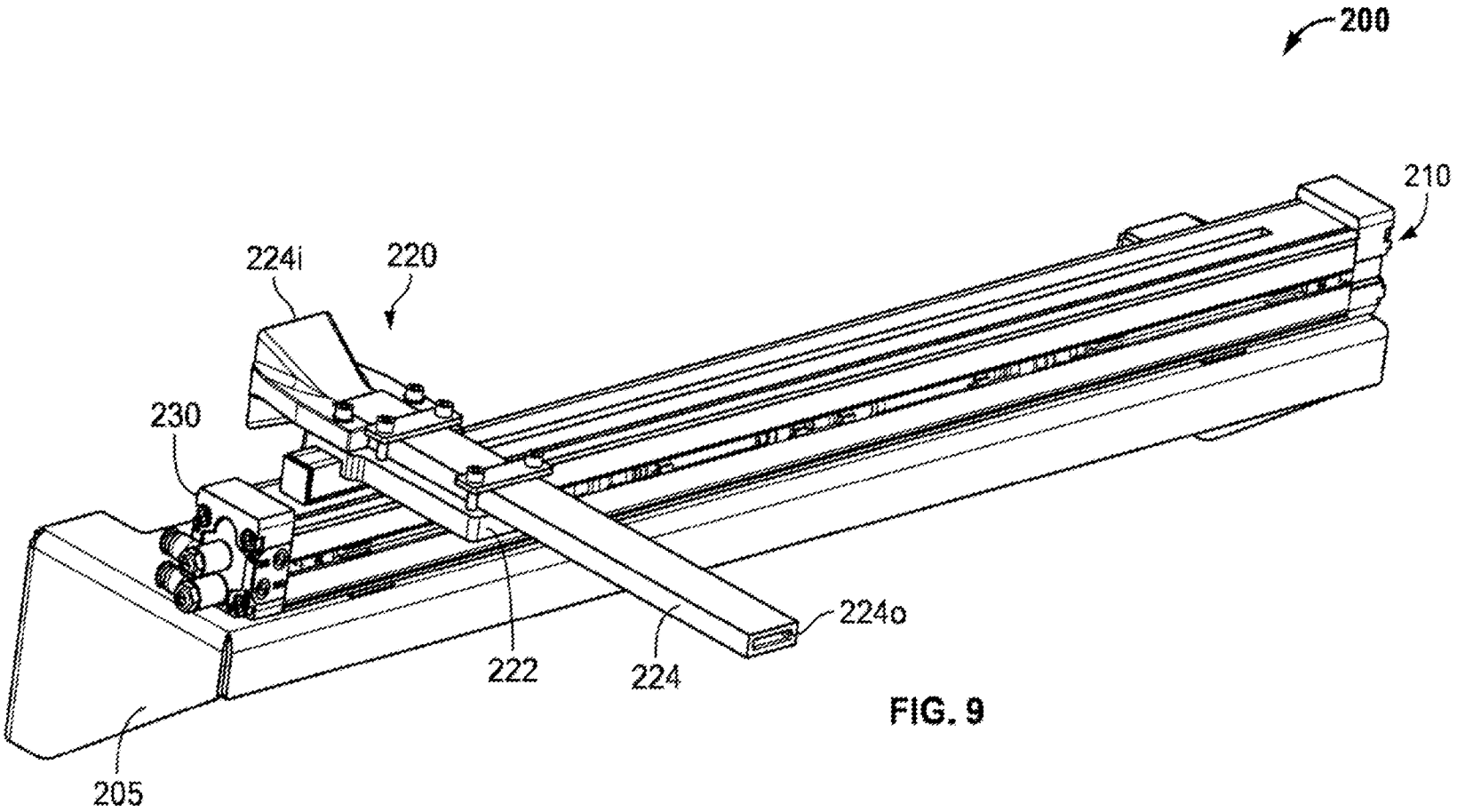
FIG. 9 is a perspective view of the strap-directing assembly of FIG. 5.

The strap-directing assembly 200 directs strap from the strap-driving assembly 100 to the strapping machine. More specifically, in this example embodiment, the strap-directing assembly 200 controls which one of the strap-driving subassemblies 100 and 200 feeds strap to the strapping machine. As shown in FIG. 9, the strap-directing assembly 200 may include a strap-directing-assembly support 205, a rail 210, a strap-directing-assembly strap guide 220, and/or a strap-directing-assembly-strap-guide actuator 230.

The strap-directing-assembly support 205 may support and/or serve as a mount for the rail 210, the strap-directing-assembly strap guide 220, and the strap-directing-assembly-strap-guide actuator 230. In this example embodiment, the strap-directing-assembly support 205 support 205 includes a bracket (though it may be any other suitable component) mounted to the housing H such that at least the rail 210 and the strap-directing-assembly strap guide 220 are downstream of the first and second strap guides 111 and 121 of the first and second strap-drive subassemblies 110 and 120.

The rail 210 may serve as a mount for the strap-directing-assembly strap guide 220. The rail 210 may be fixedly mounted to the strap-directing-assembly support 205 and oriented transvers (here, perpendicular) to the first and second strap guides 111 and 121 of the first and second strap-drive subassemblies 110 and 120.

The strap-directing-assembly strap guide 220 (which is sometimes referred to herein as the "third strap guide" for brevity) directs strap from one of the first and second strap guides 111 and 121 (depending on the position of the third strap guide 220) to the strapping machine. The third strap guide 220 may include a carriage 222 and a tubular member 224 that may be fixedly mounted to the carriage 222 to move with the carriage 222. The tubular member 224 defines a third strap channel 224*c* (not shown but given an element number for ease of reference) having a tapered third-strap-channel inlet 224*i* and a third-strap-channel outlet 224*o*. The third strap channel 224*c* may be sized, shaped, and/or otherwise configured so strap can be fed from the first or second strap channel (depending on the position of the third strap guide 220) into the third-strap-channel inlet 224*i*, move through the third strap channel 224*c*, and exit at the third-strap-channel outlet 224*o*.

The third strap guide 220 may be slidably mounted to the rail 210 and configured to move relative to the rail (and relative to the first and second strap guides 111 and 121) between: (1) a first position (FIGS. 3-5) in which the third-strap-channel inlet 224*i* is adjacent the first-strap-channel outlet 111*o* of the first strap channel 111*c*; and (2) a second position (not shown) in which the third-strap-channel inlet 224*i* is adjacent the second-strap-channel outlet 121*o* of the second strap channel 121*c*.

The strap-directing-assembly-strap-guide actuator 230 (which is sometimes referred to herein as the "third-strap-guide actuator" for brevity) is operably connected to the third strap guide 220 and configured to move the third strap guide 220 between its first and second positions. In this example embodiment, the third-strap-guide actuator includes a double-acting pneumatic cylinder, though the third-strap-guide actuator may be any other suitable actuator (such as an electric motor or a hydraulic actuator) in other embodiments. In other embodiments, a biasing element (such as a spring) biases the third strap guide to its first position or its second position. In these embodiments, the third-strap-guide actuator is operably connected to the third strap guide and configured to move the third strap guide against the biasing force of the biasing element to its first or second position (as applicable), and when necessary to allow the biasing element to move the third strap guide to its other position.

The controller 900 includes a processing device (or devices) communicatively connected to a memory device (or devices). For instance, the controller may include a programmable logic controller. The processing device may include any suitable processing device such as, but not limited to, a general-purpose processor, a special-purpose processor, a digital-signal processor, one or more microprocessors, one or more microprocessors in association with a digital-signal processor core, one or more application-specific integrated circuits, one or more field-programmable gate array circuits, one or more integrated circuits, and/or a state machine. The memory device may include any suitable memory device such as, but not limited to, read-only memory, random-access memory, one or more digital registers, cache memory, one or more semiconductor memory devices, magnetic media such as integrated hard disks and/or removable memory, magneto-optical media, and/or optical media. The memory device stores instructions executable by the processing device to control operation of the automatic strap-feeding system 1. In certain embodiments, the controller 900 is part of the automatic strap feeder 10. In other embodiments the controller 900 is part of another element of the automatic-strap-feeding system 1. In further embodiments, the controller 900 is not part of the automatic-strap-feeding system 1 but is instead part of another system (such as the strapping machine) and configured to communicate with and control the components of the automatic strap-feeding system 1.

As shown in the example of FIG. 2, the controller 900 is communicatively and operably connected to the first-counter-roller actuator 114, the second-counter-roller actuator 124, the first-upstream-strap-clamp actuator 116*u*, the first-downstream-strap-clamp actuator 116*d*, the second-upstream-strap-clamp actuator 126*u*, the second-downstream-strap-clamp actuator 126*d*, the drive-roller actuator 130, and the third-strap-guide actuator 230 and configured to receive signals from and to control those components. The controller 900 is communicatively connected to the first and second strap sensors 117 and 127 and configured to receive signals from those components.

The optional strap-supply separator S physically separates the first and second strap supplies, which ensures they do not interfere with one another and that an operator does not interfere with the strap supply that is in use while the operator is changing the strap coil of the strap supply that is not in use. In this example embodiment, the strap-supply separator includes multiple transparent or translucent barriers supported by vertical supports, though it may include any other suitable components in other embodiments. As shown in FIG. 1, the strap-supply separator S may be installed so it: (1) extends upstream of the automatic strap feeder 10; (2) is oriented transverse to the rail 210 and parallel to the first and second strap guides 111 and 121; and (3) is positioned between the first and second strap guides 111 and 121.

The fencing F physically separates the automatic strap feeder 10 from the strapping machine (not shown). As shown in FIG. 1, the fencing F may be installed so it: (1) is downstream of the automatic strap feeder 10; (2) is oriented parallel to the rail 210 and transverse to the first and second strap guides 111 and 121; and (3) is positioned so the third strap guide 220 extends through the opening O defined in the fencing F. The opening O may be sized, shaped, and/or otherwise configured to enable the third strap guide 220 to move between its first and second positions without interfering with the third strap guide 220.

Figure 10:
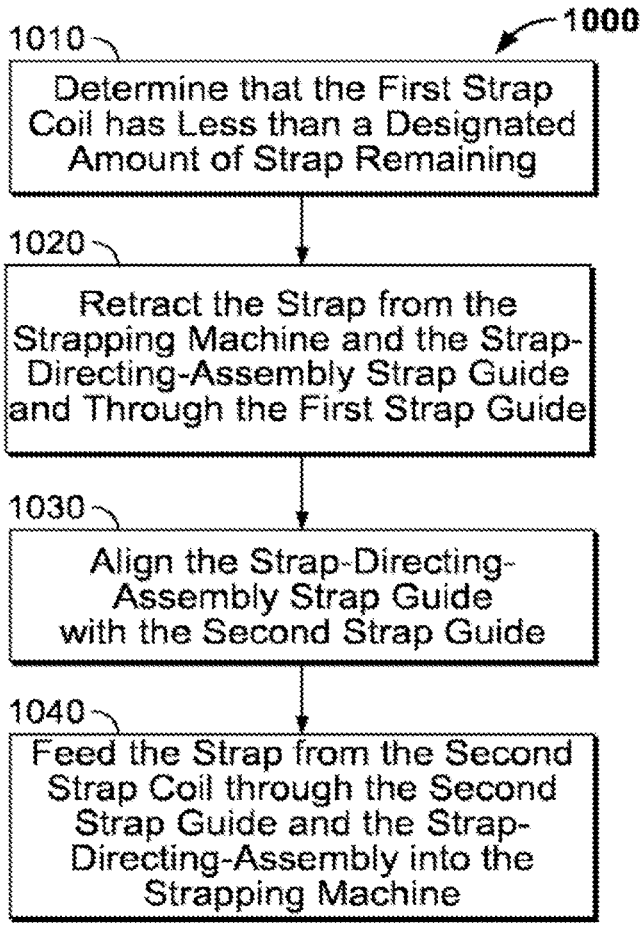
FIG. 10 is a flowchart of an example coil-switchover process of the present disclosure.

Operation of the automatic-strap-feeding system 1 to carry out a coil-switchover process 1000 is now described with reference to FIG. 10. Initially, the first strap-driving subassembly is in a configuration that enables the strapping machine to use strap from a first strap coil, and the second strap-driving subassembly is in a configuration that holds strap from a second strap coil in anticipation of feeding that strap into the strapping machine. The coil-switchover process 1000 begins upon a determination that the first strap coil has less than a designated amount of strap remaining, as block 1010 indicates. Once this occurs, the strap is retracted from the strapping machine and the strap-directing-assembly strap guide and through the first strap guide, as block 1020 indicates. The strap-directing-assembly strap guide is aligned with the second strap guide, as block 1030 indicates. The strap from the second strap coil is fed through the second strap guide and the strap-directing-assembly strap guide into the strapping machine, as block 1040 indicates. This completes the coil-switchover process 1000. Although not described here, the coil-switchover process is carried out similarly once the second strap coil has less than the designated amount of strap remaining.

The coil-switchover process is now described in detail with respect to the example embodiment of the automatic-strap-feeding system 1 described above and shown in the Figures. In this example embodiment, the first and second strap supplies include respective first and second coil-low sensors configured to detect when the strap remaining in the respective first and second coils is less than a designated amount (which may be any suitable amount, such as an amount required for the strapping machine to complete a strapping process to strap a load). The first and second coil-low sensors are communicatively connected to the controller 900 and configured to generate and send signals to the controller 900 responsive to detecting that the strap remaining in the respective first and second coils is less than the designated amount. In other embodiments, the first and second coil-low sensors are part of the automatic-strap-feeding system 1 or part of the strapping machine. In still other embodiments, only one of the first and second strap supplies includes a coil-low sensor.

Initially, the first strap-driving subassembly 110 is in a configuration that enables the strapping machine to use strap from the first strap coil. Specifically, the first counter roller 114, the first upstream strap clamp 115*u*, and the first downstream strap clamp 115*d* are in their respective retracted positions and the third strap guide 220 is in its first position. The strap extends from the first strap coil through the first strap channel 111*c* of the first strap guide 111 and through the third strap channel 224*c* of the tubular member 224 of the third strap guide 220 into the strapping machine. Initially, the second strap-driving subassembly 120 is in a configuration that holds strap from the second strap coil in anticipation of feeding that strap into the strapping machine. Specifically, the second counter roller 123 is in its engaged position and forces the strap against the second drive roller 122, and the second upstream and downstream strap clamps 125*u* and 125*d* are in their respective clamping positions and clamping the strap against the second strap guide 121.

Turning now to the coil-switchover process 1000, when the strap remaining in the first strap coil falls below the designated amount, the first coil-low sensor generates and sends a corresponding signal to the controller 900. Upon receiving that signal, the controller 900 determines that the first strap coil has less than the designated amount of strap remaining (block 1010). In response, the controller 900 causes the strapping machine to release the strap; controls the first-counter-roller actuator 114 to move the first counter roller 113 to its engaged position to force the strap against the first drive roller 112; and controls the drive-roller actuator 130 to rotate the first drive roller 112 to move the strap in the upstream direction and to retract the strap from the strapping machine, the movable strap chute 220, and the first strap guide 111 (block 1020).

After the strap has been retracted from the movable strap chute 220 and the first strap guide 111, the controller 900 controls the third-strap-guide actuator 230 to move the third strap guide 220 from its first position to its second position to align it with the second strap guide 121 (block 1030) and controls the first-counter-roller actuator 114 to move the first counter roller 113 to its retracted position in preparation for the strap-loading process 1500 (described below). After the third strap guide 220 has reached its second position, the controller 900 determines whether strap from the second strap coil is ready to be fed to the strapping machine. The controller 900 determines that this is the case responsive to receiving a signal from the second strap sensor 127 that the second strap sensor 127 detects strap. The controller 900 then controls the second-upstream- and downstream-strap-clamp actuators 126*u* and 126*d* to move the second upstream and downstream strap clamps 125*u* and 125*d* from their respective clamping positions to their respective retracted positions to release the strap and controls the drive-roller actuator 130 to rotate the second drive roller 122 to move the strap in the downstream direction into the movable strap chute 220 and from the movable strap chute 220 into the strapping machine (block 1040). Once the strapping machine receives the strap, the controller 900 controls the second-counter-roller actuator 124 to move the second counter roller 123 from its engaged position to its retracted position to enable the strapping machine to freely draw the strap from the second strap coil through the automatic strap feeder 10.

Figure 11:
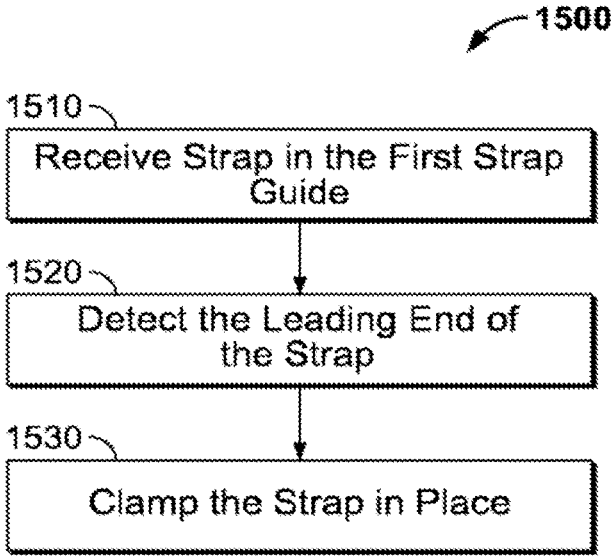
FIG. 11 is a flowchart of an example strap-loading process of the present disclosure.

Operation of the automatic-strap-feeding system 1 to carry out a strap-loading process 1500 is now described with reference to FIG. 11. While the strap-loading process 1500 is described below with respect to the first strap-driving subassembly, the strap-loading process doesn't change when performed for the second strap-driving subassembly. The coil-switchover process 1000 begins when strap from a new strap coil (replacing the first strap coil) is received in the first strap guide, as block 1510 indicates. Eventually the leading end of the strap is detected, as block 1520 indicates. The strap is clamped in place in response to detection of the leading end, as block 1530 indicates. This completes the strap-loading process 1500.

The strap-loading process 1500 is now described in detail with respect to the example embodiment of the automatic-strap-feeding system 1 described above and shown in the Figures. Initially, the first counter roller 114, the first upstream strap clamp 115*u*, and the first downstream strap clamp 115*d* are in their respective retracted positions. The first strap guide 111 receives strap, leading end first, in the first strap-channel inlet 111*i* (block 1510). For instance, the operator who replaced the depleted first strap coil with the new strap coil may introduce the strap into the first strap guide 111. Eventually the first strap sensor 117 detects the leading end of the strap (block 1520). The first strap sensor 117 generates and sends a corresponding signal to the controller 900. In response, the controller 900 controls the first-upstream and -downstream-strap-clamp actuators 116*u* and 116*d* to move the first upstream and downstream strap clamps 115*u* and 115*d* from their respective retracted positions to their respective clamping positions to clamp the strap against the first strap guide 111 (block 1530). Also in response to receiving this signal, the controller 900 controls the first-counter-roller actuator 114 to move the first counter roller 113 from its retracted position to its engaged position to force the strap against the first drive roller 112 in preparation to feed the strap to the strapping machine. In other embodiments the controller 900 does not carry out this final step until after determining that the second strap coil has less than the designated amount of strap remaining or until after moving the movable strap chute 220 back to the first position.

While the embodiment described above and shown in the Figures includes two strap-driving subassemblies, in other embodiments the strap-driving assembly may include any suitable quantity of strap-driving subassemblies associated with their own individual strap supplies and strap coils.

In other embodiments, the strap-directing assembly guide is fixed relative to the housing of the automatic strap feeder, and the strap-driving-assembly strap guides are movable relative to the strap-directing-assembly strap guide. In these embodiments, the automatic strap feeder includes a strap-directing-assembly actuator operably connected to the strap-directing assembly and configured to move the strap-directing assembly between: (1) a first position in which the first-strap-channel outlet of the first strap channel of the first strap-driving-subassembly guide is adjacent the strap-channel inlet of the strap channel of the strap-driving-assembly guide; and (2) a second position in which the second-strap-channel outlet of the second strap channel of the second strap-driving-subassembly guide is adjacent the strap-channel inlet of the strap channel of the strap-driving-assembly guide. Accordingly, in these embodiments, the position of the strap-driving assembly controls which one of the strap-driving subassemblies and feeds strap to the strapping machine.

In certain embodiments, the strap-directing-assembly strap guide is upstream of the strap-driving-assembly strap guides. In these embodiments, the strap-driving assembly is not configured to clamp the strap in preparation for the switchover from one strap coil to the next. Rather, in these embodiments, the operator (or an automatic strap feeder) feeds strap into the strap-channel inlet of the strap-directing-assembly strap guide once the strap-directing-assembly strap guide moves into position adjacent the new (full) coil.

What is claimed is:

1. An automatic-strap-feeding system for selectively feeding strap from a first strap coil and strap from a second strap coil into a strapping machine, the automatic-strap-feeding system comprising:

a strap-driving assembly comprising:

a first strap guide defining a first strap channel;

a first drive roller adjacent the first strap channel and configured to move strap from the first strap coil through the first strap channel;

a second strap guide spaced-apart from the first strap guide and defining a second strap channel;

a second drive roller adjacent the second strap channel and configured to move strap from the second strap coil through the second strap channel; and one or more drive-roller actuators operably connected to the first and second drive rollers and configured to drive the first and second drive rollers; and a third strap guide defining a third strap channel;

wherein the third strap guide is movable relative to the first and second strap guides between a first position in which the third strap channel is aligned with the first strap channel and a second position in which the third strap channel is aligned with the second strap channel.

2. The automatic-strap-feeding system of claim 1, further comprising a third-strap-guide actuator operably connected to the third strap guide and configured to move the third strap guide between its first and second positions.

3. The automatic-strap-feeding system of claim 1, wherein the strap-driving assembly further comprises:

a first strap clamp comprising a head and a body connected to the head, the first strap clamp movable relative to the first strap guide between a clamping position in which the head is at least partially positioned in the first strap channel and a retracted position in which the head is removed from the first strap channel; and a second strap clamp comprising a head and a body connected to the head, the second strap clamp movable relative to the second strap guide between a clamping position in which the head is at least partially positioned in the second strap channel and a retracted position in which the head is removed from the second strap channel.

4. The automatic-strap-feeding system of claim 3, wherein the strap-driving assembly further comprises:

a first-strap-clamp actuator operably connected to the first strap clamp and configured to move the first strap clamp from its retracted position to its clamping position; and a second-strap-clamp actuator operably connected to the second strap clamp and configured to move the second strap clamp from its retracted position to its clamping position.

5. The automatic-strap-feeding system of claim 1, wherein the strap-driving assembly further comprises:

a first counter roller movable relative to the first drive roller between an engaged position adjacent the first drive roller and a retracted position further from the first drive roller; and a second counter roller movable relative to the second drive roller between an engaged position adjacent the second drive roller and a retracted position further from the second drive roller.

6. The automatic-strap-feeding system of claim 5, wherein the strap-driving assembly further comprises:

a first-counter-roller actuator operably connected to the first counter roller and configured to move the first counter roller from its retracted position to its engaged position; and a second-counter-roller actuator operably connected to the second counter roller and configured to move the second counter roller from its retracted position to its engaged position.

7. The automatic-strap-feeding system of claim 5, wherein at least part of the first counter roller is positioned in the first strap channel when the first counter roller is in its engaged position, wherein at least part of the second counter roller is positioned in the second strap channel when the second counter roller is in its engaged position.

8. The automatic strap-feeding system of claim 1, wherein the strap- driving assembly further comprises a first strap sensor positioned to sense strap in the first strap guide and a second strap sensor positioned to sense strap in the second strap guide.

9. The automatic strap-feeding system of claim 1, wherein when the third strap guide is in its first position a third inlet of the third-strap-channel is adjacent a first outlet of the first-strap-channel, and wherein when the third strap guide is in its second position the third inlet of the third-strap-channel is adjacent to a second outlet of the second-strap-channel.

* * * * *